US011725445B2

(12) United States Patent
Hellwig et al.

(10) Patent No.: US 11,725,445 B2
(45) Date of Patent: Aug. 15, 2023

(54) BACKPLATE FOR A DOOR ACTUATOR

(71) Applicant: dormakaba Deutschland GmbH, Ennepetal (DE)

(72) Inventors: Alexander Hellwig, Ennepetal (DE); Thomas Salutzki, Ennepetal (DE); Sabine Wiemann, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 181 days.

(21) Appl. No.: 17/320,642

(22) Filed: May 14, 2021

(65) Prior Publication Data

US 2021/0388657 A1 Dec. 16, 2021

(30) Foreign Application Priority Data

Jun. 15, 2020 (EP) ..... 20180010

(51) Int. Cl.
*E05F 3/22* (2006.01)
*E05F 3/06* (2006.01)

(52) U.S. Cl.
CPC ..... *E05F 3/227* (2013.01); *E05F 3/06* (2013.01); *E05Y 2900/132* (2013.01)

(58) Field of Classification Search
CPC .. E05F 3/227; E05F 3/06; E05F 1/006; E05Y 2900/132
See application file for complete search history.

(56) References Cited

U.S. PATENT DOCUMENTS

| | | | | |
|---|---|---|---|---|
| 6,363,575 | B1 * | 4/2002 | Kaser | E05B 65/104 16/48.5 |
| 11,578,522 | B2 * | 2/2023 | Hellwig | E05F 1/006 |
| 2022/0018175 | A1 * | 1/2022 | Hellwig | E05F 1/006 |
| 2022/0186527 | A1 * | 6/2022 | Hellwig | E05F 3/227 |

FOREIGN PATENT DOCUMENTS

| | | | |
|---|---|---|---|
| DE | 4406938 | A1 | 9/1994 |
| DE | 29880074 | U1 | 4/2000 |
| EP | 3425150 | A1 | 1/2019 |
| ES | 2320068 | A1 | 5/2009 |
| KR | 20100112513 | A | 10/2010 |
| WO | 2010144078 | A1 | 12/2010 |

* cited by examiner

*Primary Examiner* — Victor D Batson
*Assistant Examiner* — Matthew J Sullivan
(74) *Attorney, Agent, or Firm* — Cantor Colburn LLP

(57) ABSTRACT

A backplate for a door actuator, includes at least two mounting elements, one of the two mounting elements being formed for fastening to a mounting surface, in particular door, casing or wall, and the other mounting element for accommodating the door actuator. The backplate further includes at least one connecting assembly with a bar element mobile disposed at the first mounting element and a thermally activatable trigger element. The bar element is movable from a retaining position to a release position. In the retaining position, the bar element retains the second mounting element and, in the release position, releases the second mounting element. When thermally activated, the trigger element releases a movement of the bar element to the release position and/or, the trigger element moves the bar element to the release position.

15 Claims, 7 Drawing Sheets

A - A

B - B

C - C

D - D

BACKPLATE FOR A DOOR ACTUATOR

CROSS-REFERENCE TO RELATED APPLICATIONS

This application claims priority to European Patent Application No. 20180010.9, filed on Jun. 15, 2020, the contents of which are hereby incorporated by reference in their entirety.

TECHNICAL FIELD

The disclosure relates to a backplate for a door actuator.

BACKGROUND

Door actuators are used for closing and/or opening doors. In particular, door closers and door drives are designated as door actuators. Generally, in a door closer, the manual opening movement charges a spring accumulator. In this case, the stored energy is used for closing the door. For example, in the door drive, electro-mechanics or hydraulics allow for automatically open and/or close the door. Usually, door actuators are fastened to the door leaf or the casing, respectively the wall. Most of the time, mounting plates are used for fastening the door actuator. The mounting plate is fastened to the mounting surface thereof, namely the door, casing or wall. In turn the door actuator is fastened to the mounting plate.

In particular, with fire-rated doors, it should be noted that often combustible fluids, in particular hydraulic oils, are used in the door actuators. In the event of a fire, as much as possible, suitable measures should allow for preventing the fluid in the door actuator from heating up too much and potentially from igniting.

SUMMARY

The present disclosure provides a backplate for a door actuator, which fulfils dependable fastening of the door actuator and simultaneously safety relevant requirements, in particular in the event of a fire.

This is achieved with the features of the independent claim. Advantageous further configurations of the disclosure are the subject matter of the dependent claims.

The disclosure describes a backplate, which is used instead of a conventional mounting plate for fastening the door actuator. The backplate includes a first mounting element and at least one second mounting element. The mounting elements are connected to each other via at least one connecting assembly. Under corresponding thermal load, the connecting assembly detaches so that the two mounting elements separate from each other. Thereby, the door actuator detaches from the mounting surface, namely the door, casing or wall. In particular in this case, it is assumed that the door actuator is located on the side of the door facing away from the fire. The door actuator detaching from the mounting surface thereof, prevents the door actuator from heating up too much, whereby the fluids in the door actuator are prevented from igniting.

For describing directions, a mounting axis is defined at the backplate. The mounting axis is parallel to the screws, for example, which are used for screwing the backplate to the mounting surface. According to an alternative definition, the mounting axis is vertical to the output axis of the door actuator. According to another alternative definition, the mounting axis is vertical to the mounting surface, namely vertical to the surface of the door, casing or wall.

As already described, the backplate comprises a first mounting element and at least one second mounting element. According to a herein described exemplary embodiment, the two mounting elements are plates, respectively plate-shaped elements, which rest against each other for forming the backplate. However, according to a second exemplary embodiment, several second mounting elements are used, in particular in the form of bushings, which are inserted in the first mounting element. For the sake of clarity, most of the time the second mounting element is described in singular; however, in this case, it is always disclosed that several second mounting elements having the corresponding embodiment can be used.

In particular, it is provided the first mounting element with the rear surface thereof is fastened, in particular screwed, to the mounting surface. A door, casing or wall forms said mounting surface. Accordingly, the second mounting element is connected to the door actuator. In particular, the second mounting element has a front surface, to which the door actuator is fastened, in particular screwed. Preferably, the second mounting element is a self-contained component, to which the door actuator is fastened. However, as an alternative, the second mounting element can be an integral component of the door actuator.

Furthermore, the inverse configuration is possible, whereby the first mounting element is formed for accommodating the door actuator and the second mounting element is fastened to the mounting surface.

The backplate comprises at least one connecting assembly. In particular, one, two, three, four or five such connecting assemblies are provided.

The individual connecting assembly comprises at least one bar element. The bar element is disposed mobile at the first mounting element. In particular, the bar element is disposed linearly mobile with regard to the first mounting element. The first mounting element is formed in particular as a plate, and accordingly includes a plate plane, which is vertical to the mounting axis. With the intention to achieve an as thin as possible a structure of the backplate, in particular it is provided that the bar element moves parallel to the plate plane and thus vertically to the mounting axis.

Furthermore, the connecting assembly comprises at least one trigger element. The trigger element is thermally activatable, in particular in a temperature range of 90° C. to 200° C. "Activating the trigger element" means the same as "triggering the trigger element". For example, the trigger element is a glass vial filled with fluid, such as known in sprinkler systems, for example. The trigger element is formed so as to trigger at a corresponding temperature, which is appropriate for preventing the door actuator from uncontrolled leaking the fluid.

The bar element is movable from the retaining position thereof to a release position. In the basic condition, namely when the trigger element has not been triggered, the bar element is in the retaining position thereof and, in this case, retains the second mounting element. If several second mounting elements are provided, in particular bushings, a bar element can retain even several second mounting elements. In the release position, the bar element releases the second mounting element, so that the two mounting elements (first and second mounting elements) can detach from each other. Thereby, the door actuator detaches from the mounting surface, namely the door, casing or wall.

When thermally activated, the trigger element is formed for releasing the movement of the bar element to the release position thereof. In this case in particular, it is provided the trigger element just releases said movement and does not exert any force on the bar element for moving the same. Once the trigger element released the bar element, the same can be moved to the release position thereof under the load of gravity and/or by a so-called "drive element".

However, in an alternative embodiment, it is also possible, when thermally activated, the trigger element moves the bar element to the release position. This is in particular possible in that the trigger element comprises thermally intumescent material. Upon corresponding heating, said thermally intumescent material expands. Said expanding material can be used for moving the bar element in the desired direction. In this configuration, the bar element is blocked in the retaining position thereof, preferably via a mechanical blocking element. Said mechanical blocking element is detachable such as to detach, when, upon thermal activation, the trigger element moves, in particular pushes the bar element to the release position. For being detachable, in particular, the blocking element can be deformable and/or destructible and/or otherwise detachable under traction or pressure.

However, particularly preferred and further described is the variant, in which the trigger element just releases the bar element and the movement of the bar element is realized otherwise, in particular under the load of gravity and/or by the drive element.

In a preferred embodiment, it is provided, that the trigger element is disposed, in particular clamped between bar element and first mounting element, in order to block a movement of the bar element to the release position. For this purpose, it is in particular provided the trigger element is destructible and/or deformable and/or meltable under thermal load.

An exemplary configuration for the trigger element is the above-described glass vial. Another example is a meltable alloy or a corresponding meltable, respectively thermally deformable plastic material.

Preferably, the trigger element is clamped between first mounting element and bar element by a compensating spring. Said compensating spring avoids too strong a clamping, respectively unwanted destruction of the trigger element.

Preferably, a screw is provided, by means of which the trigger element can be tightened against the compensating spring.

Preferably, the bar element is seated in a recess of the first mounting element. Preferably, at least in sections, the recess is formed as a pocket for receiving the bar element and thus is closed on one of the two sides, which are vertical to the mounting axis.

Preferably, in the retaining position thereof, the bar element and the second mounting element engage positively in each other. When configuring the second mounting element as a plate, preferably it is provided the second mounting element includes a plate body, from which extends at least one form closure element in the direction of the mounting surface. Preferably, said form closure element is seated in a corresponding recess of the first mounting elements formed as a plate. Preferably, in the retaining position, the bar element engages in the associated form closure element.

When using several second mounting elements, for example formed as bushings, preferably, it is provided the second mounting elements include a groove at the outer circumference thereof. A fork-shaped section of the bar element can engage in said groove so that the second mounting element is secured against falling out. Furthermore, the outer circumference can be non-round in the groove, in particular include a polygon, so that the fork-shaped section of the bar element also secures the bushing against rotation.

In a preferred embodiment, it is provided the connecting assembly comprises the already mentioned drive element. In particular said drive element comprises a thermally intumescent material and/or a spring. The drive element is formed for moving the bar element to the release position. Thus, the drive element moves the bar element in particular in a direction vertical to the mounting axis.

As soon as the trigger element has triggered, the bar element ceases to be blocked. Thereby, the drive element can move the bar element to the release position, be it by the thermally intumescent material and/or a spring.

Preferably, the drive element is seated in a recess of the first mounting element and/or in a recess of the second mounting element. In order to employ an as large as possible a drive element, in particular with thermally intumescent material, preferably, it is provided the two recesses in the two mounting elements are aligned with each other so that the drive element can be disposed in both mounting elements formed as plates. In this case, preferably, it is then also provided the bar element extends into the recess of the second mounting element so that the drive element is able to act on the bar element via an as large as possible a surface.

Furthermore preferably, a detaching element is provided. The detaching element can likewise comprise thermally intumescent material and/or a spring. The detaching element is disposed to push the two mounting elements away from each other. Essentially, the detaching element performs a movement parallel to the mounting axis. In this case, the detaching element can directly act on the two mounting elements and push them apart. However, it is also possible the detaching element props up on the backside directly against the mounting surface. In the same manner, the detaching element can prop up on the front side directly against the door actuator. One essential function of the detaching element, after the movement of the bar element, is to have the door actuator move away from the mounting surface.

Preferably, for a compact structure, it is provided the detaching element is located in a recess of the first mounting element and/or in a recess of the second mounting element.

Furthermore preferably, it is provided to use thermally intumescent material for the detaching element, which triggers only at a higher temperature than the thermally intumescent material, which is used in the drive element.

As already described, preferably, it is provided the first mounting element is formed as a plate. In a preferred embodiment, also the second mounting element is formed as a plate. The two plates have respectively one inner surface, which rest against each other. The first mounting element forms a rear surface, which comes to rest at the mounting surface, in particular the door, casing or wall. The second mounting element forms a front surface, to which the door actuator is fastened.

As an alternative to the configuration of the second mounting element as a plate, preferably, it is provided to provide several second mounting elements. Preferably, said several second mounting elements are formed respectively as a bushing. Preferably, the bushings have a female thread. The door actuator can be screwed to the second mounting elements via said female thread.

As an alternative to the configuration as a bushing, the second mounting elements can be formed as threaded pins for example, which protrude from the first mounting element.

The backplate, independently of the second mounting element being formed as a plate or not, preferably has a thickness of maximum 60 mm, in particular maximum 40 mm. Said relatively thin configuration results in an appearance just like a normal mounting plate. In particular, the thickness is measured from the rear surface to the front surface. Potential positioning extensions or other elements, on which the door actuators are fitted, remain disregarded.

Furthermore, the disclosure comprises an assembly, comprising the described backplate and a door actuator. In this case, the door actuator is fastened to the second mounting element, respectively to several second mounting elements. Preferably, the backplate is fastened to a mounting surface, in particular door, casing or wall.

BRIEF DESCRIPTION OF THE DRAWINGS

The disclosure is now described in more detail based on exemplary embodiments. In this case, it shows.

DETAILED DESCRIPTION OF THE DRAWINGS

In the following, an assembly 100 and a backplate 1 are described in detail based on the Figures. FIGS. 1 to 7 show the configuration according to a first exemplary embodiment. FIGS. 8 to 13 show a second exemplary embodiment of the backplate 1.

Figure 1:
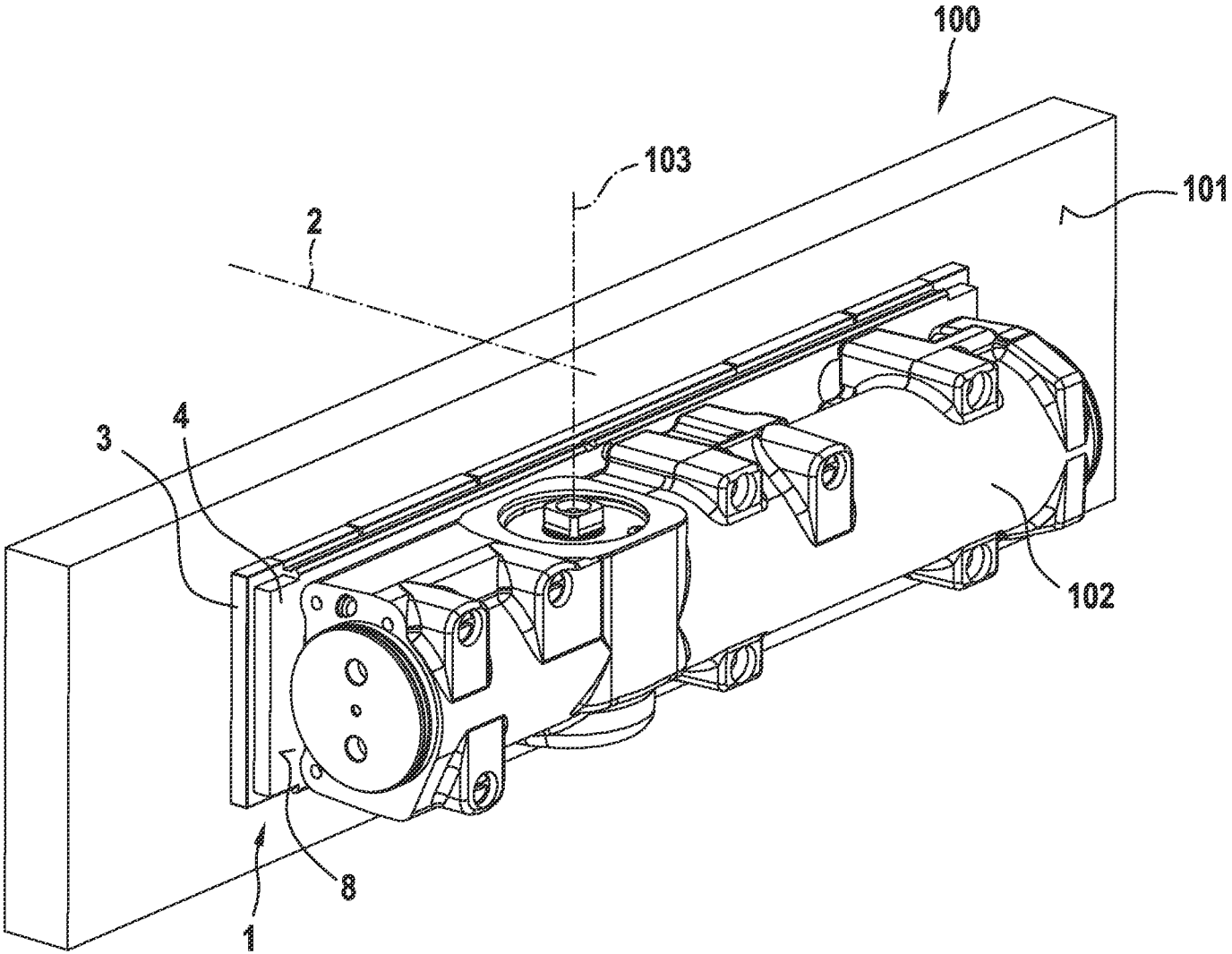
FIG. 1 an inventive assembly with inventive backplate according to a first exemplary embodiment, FIG. 2 a rear surface of the inventive backplate according to the first exemplary embodiment, FIG. 3 an inner surface of the second mounting element of the inventive backplate according to the first exemplary embodiment, FIG. 4 an inner surface of the first mounting element of the inventive backplate according to the first exemplary embodiment, FIG. 5 the section A-A identified in FIG. 2, FIG. 6 the section B-B identified in FIG. 2, FIG. 7 a diagrammatic view of the inventive backplate according to a first exemplary embodiment when the door actuator detaches, FIG. 8 a rear surface of an inventive backplate according to a second exemplary embodiment, FIG. 9 the section C-C identified in FIG. 8, FIG. 10 another sectional view of the inventive backplate according to the second exemplary embodiment, FIG. 11 the section D-D identified in FIG. 8, FIG. 12 a first variant to the second exemplary embodiment, FIG. 13 a second variant to the second exemplary embodiment.

For describing the first exemplary embodiment, reference is made to the FIGS. 1 to 7. FIG. 1 shows purely diagrammatically a mounting surface 101 of the assembly 100. A door, casing or wall forms said mounting surface 101, for example. A mounting axis 2 is defined vertically to the mounting surface 101. The backplate 1 is fastened to the mounting surface 101. The door actuator 102 is mounted in turn on the backplate 1. The door actuator 102, herein formed as a door closer, includes an output axis 103. The output axis 103 is vertical to the mounting axis 2. The mounting axis 2 is vertical to the mounting surface 101.

The backplate 1 comprises a first mounting element 3 and a second mounting element 4. With the rear surface 6 thereof, the first mounting element 3 rests at the mounting surface 101. The two inner surfaces 7 of the two mounting elements 3, 4 rest against each other. The front surface 8 of the second mounting element 4 serves for accommodating the door actuator 102.

Figure 2:
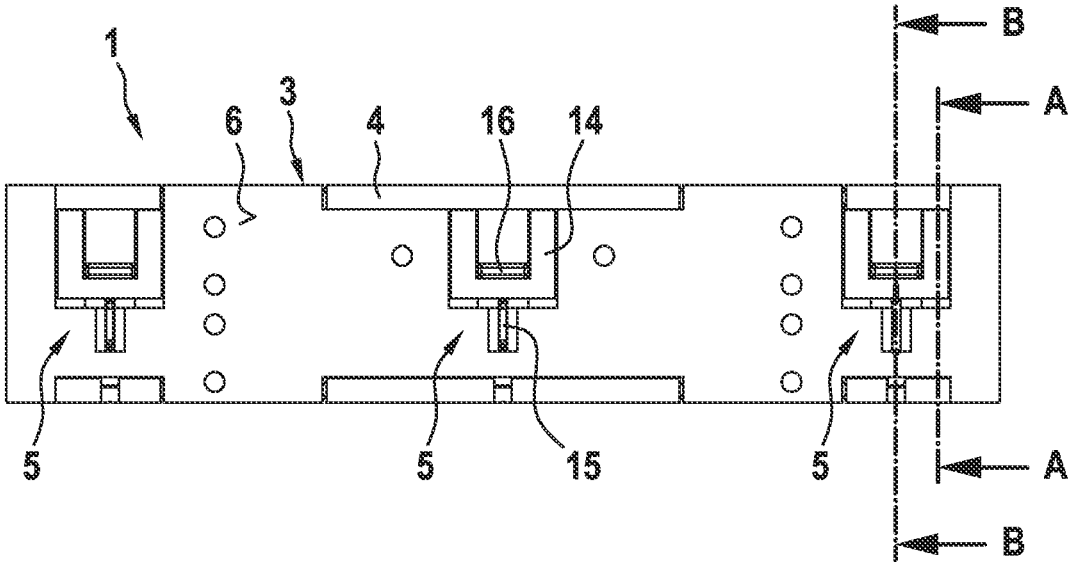
Figure 3:
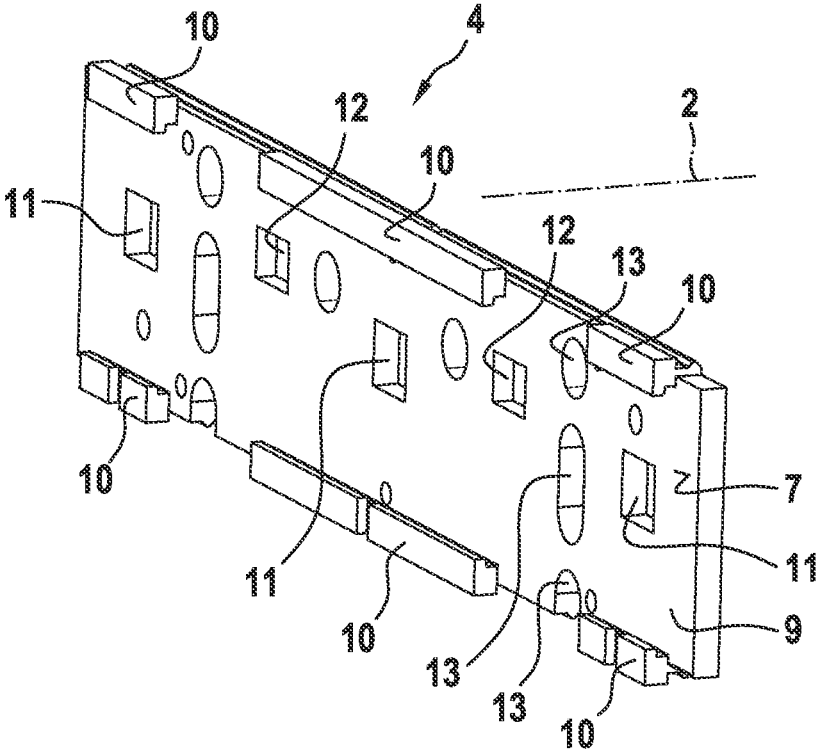
Figure 4:
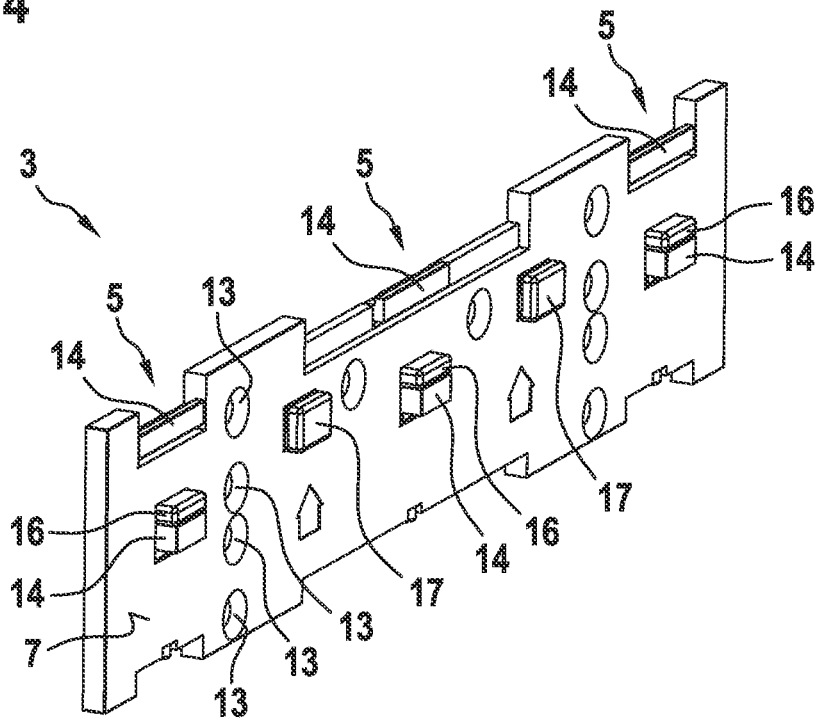
Figure 5:
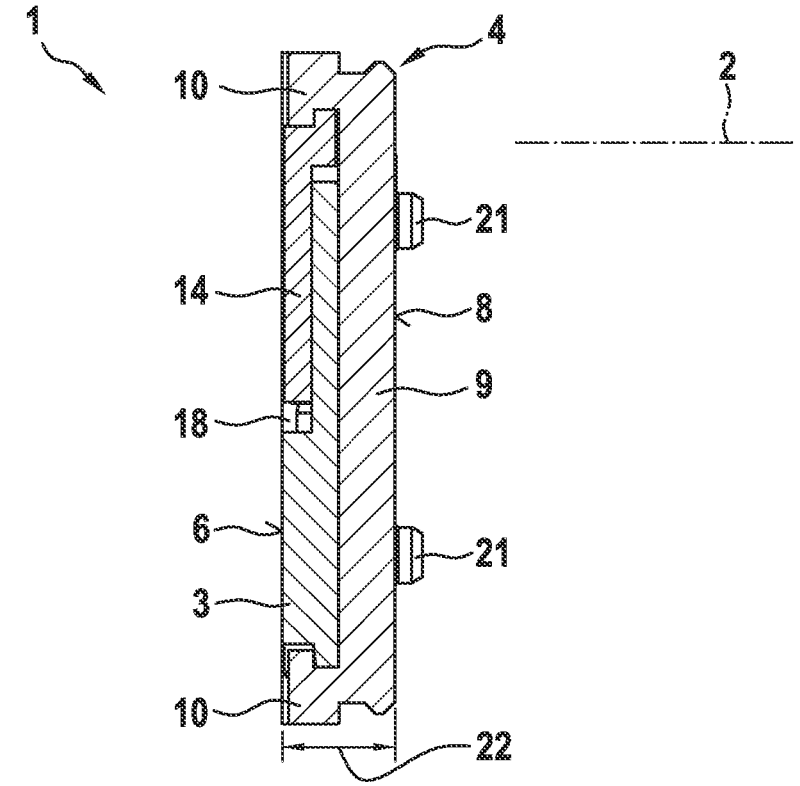
Figure 7:
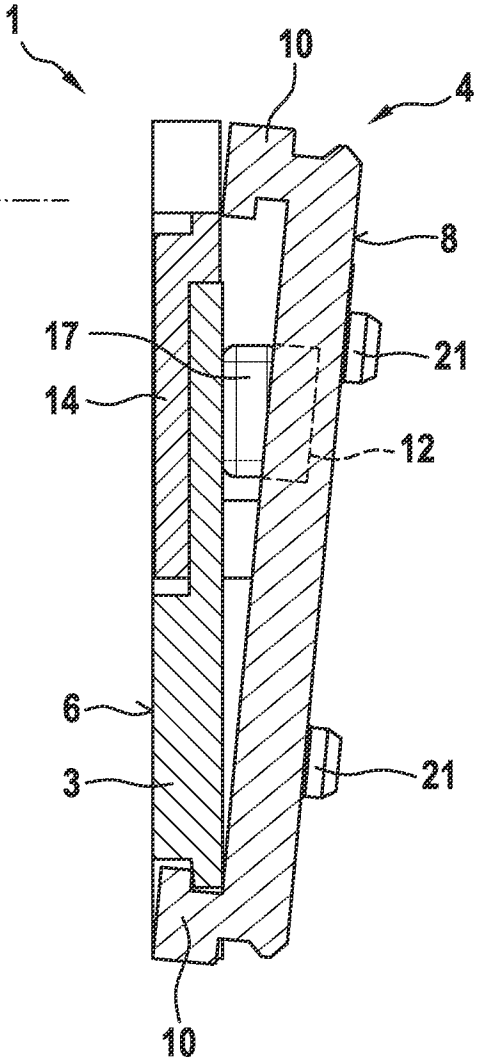
Figure 6:
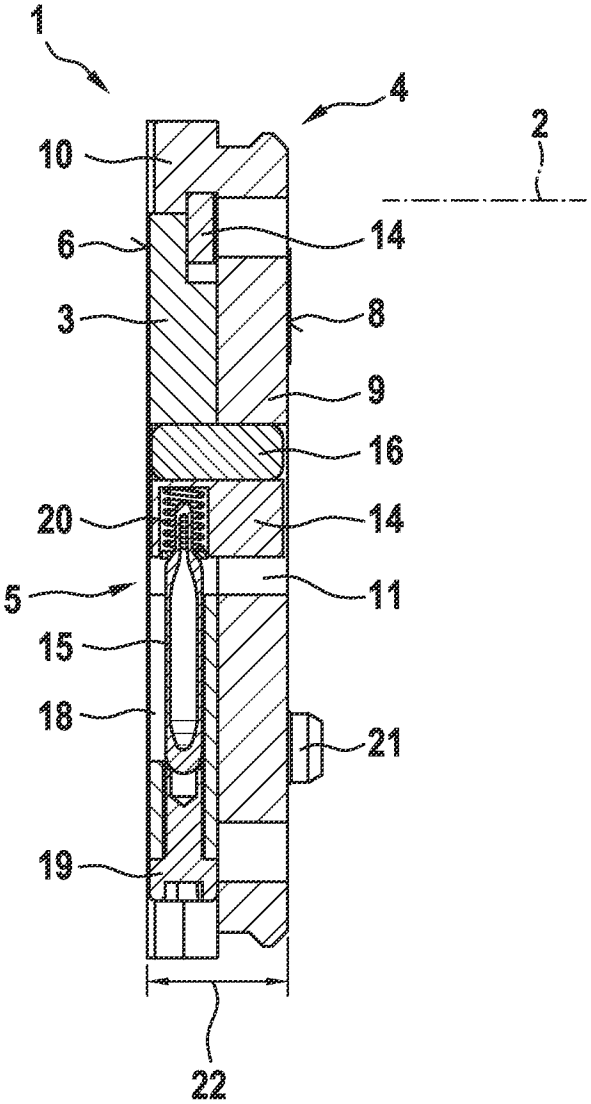

FIG. 2 shows the rear surface 6 of the backplate 1. FIG. 3 shows the inner surface 7 of the second mounting element 4. FIG. 4 shows the inner surface 7 of the first mounting element 3. FIG. 5 shows the section A-A identified in FIG. 2, and FIG. 6 shows the section B-B identified in FIG. 2. FIG. 7 shows a diagrammatic view of the backplate 1 when the door actuator 102 detaches.

The two mounting elements 3, 4 are respectively plate-shaped formed and are vertical to the mounting axis 2. The two mounting elements 3, 4 are connected to each other via three connecting assemblies 5.

The second mounting element 4 includes a plate body 9, for example according to the illustration in FIG. 3. Several form closure elements 10 extend from said plate body 9 in the direction of the first mounting element 3.

Furthermore, the plate body 9 includes first recesses 11. Said first recesses 11 are passage recesses.

Furthermore, the plate body 9 includes several second recesses 12, formed as pockets. At the inner surface 7, the second recesses 12 are open.

The plate body 9 of the second mounting element 4 and the first mounting element 3 comprise several mounting openings 13. Said mounting openings 13 are passage recesses, in particular through-holes, which extend aligned through both mounting elements 3, 4. In particular, when installing the backplate, the two mounting elements 3, 4 are already connected to each other. The screws for fastening to the mounting surface 101 are placed from the front side 8 through both mounting elements 3, 4. The mounting openings 13 in the second mounting element 4 are correspondingly large and are used as tool openings, so as to be able to fasten just the first mounting element 3 to the mounting surface 101 with the screws.

The individual connecting assembly 5 comprises respectively one bar element 14. In the exemplary embodiment shown, the single bar element 14 is formed U-shaped. The bar element 14 is located in a third recess 13 in the plate-shaped first mounting element 3. In said third recess 18, the bar element 14 is linearly mobile vertically to the mounting surface 2.

For example, FIG. 2 shows the bar elements 14 in the retaining position thereof. In this case, the bar elements 14 positively engage in the form closure elements 10 of the second mounting element 4.

One trigger element 15 is provided in each connecting assembly 5. Herein, said trigger element 15 is formed as a glass vial. The trigger element 15 retains the associated bar element 14 in the upper retaining position. Furthermore, per connecting assembly 5, one drive element 16 is located in the third recess 18. The respective drive element 16 is disposed between bar element 14 and first mounting element 3. Herein, the drive element 16 is formed from thermally intumescent material.

As for example the sectional view in FIG. 6 shows, in the first mounting element 3, the third recess 18 continues in the first recess 11 in the second mounting element 4. Thereby, the bar element 14 and the drive element 16 can extend into both recesses 18, 11.

Likewise, the sectional view in FIG. 6 shows that the trigger element 15 is tensioned with a set screw 19 against a compensating spring 20. Thereby, the trigger element 15 is clamped between bar element 15 and first mounting element 3.

A detaching element 17 (see FIG. 4), herein likewise formed as thermally intumescent material, is located in the second recess 12 of the second mounting element 4.

The trigger element 15 is destroyed at corresponding thermal load. Furthermore, the drive element 16 expands under the thermal effect and thereby presses the bar element 14 downwards. The form closure ceases between the two mounting elements 3, 4. As diagrammatically clarified in FIG. 7, in the next step, the detaching element 17 expands and thereby pushes the two mounting elements 3, 4 apart in the direction parallel to the mounting axis 2. Thereby, the door actuator 102 detaches from the mounting surface 101.

Figure 8:
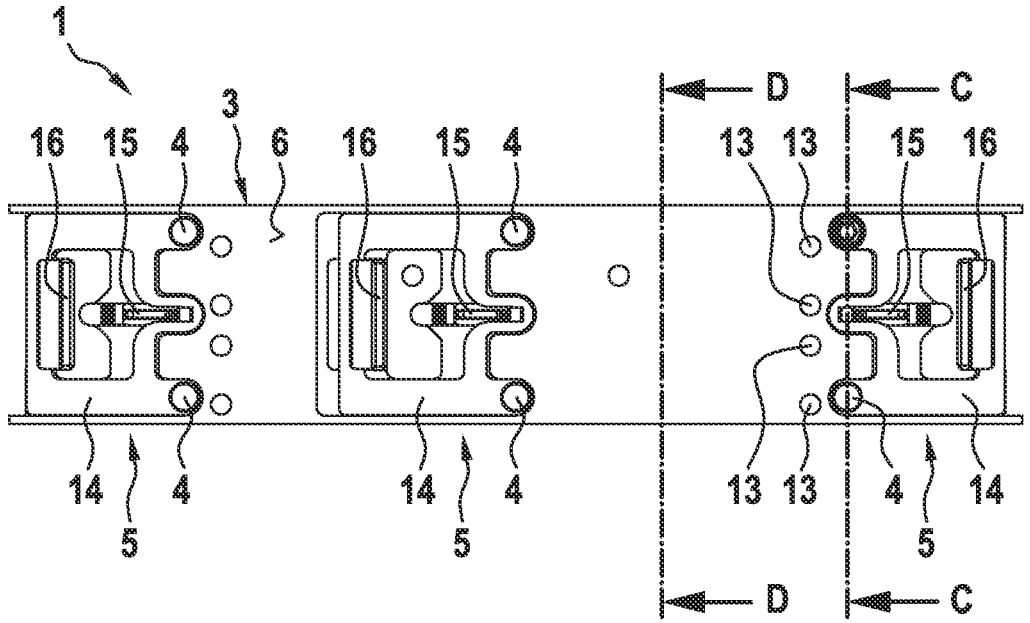
Figure 9:
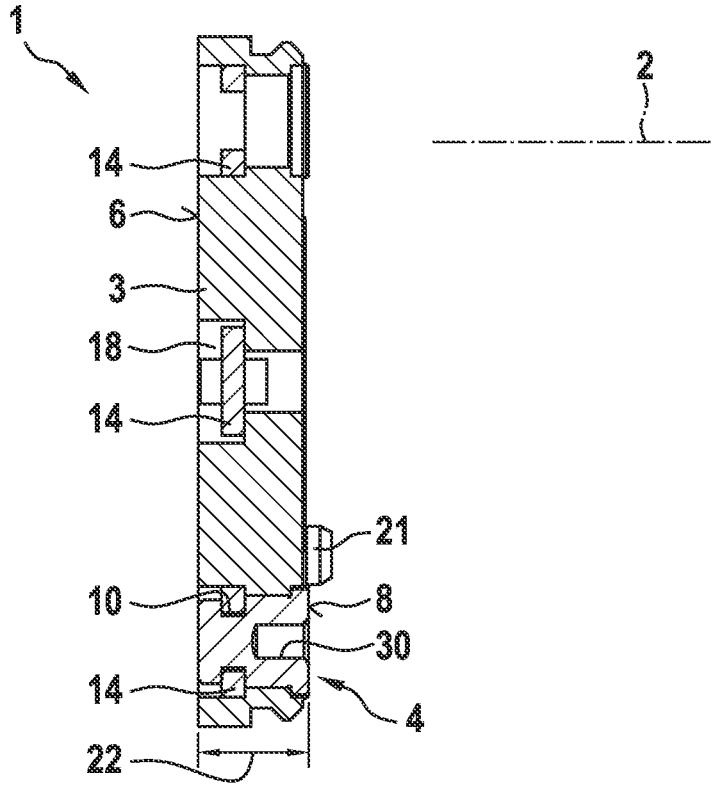
Figure 10:
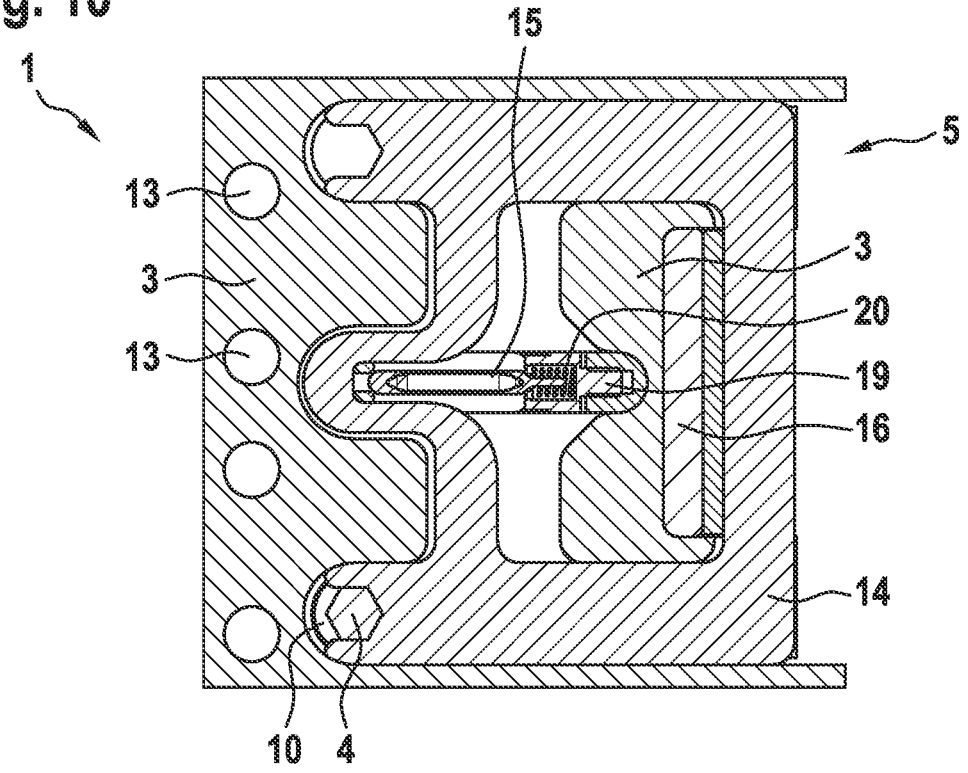
Figure 11:
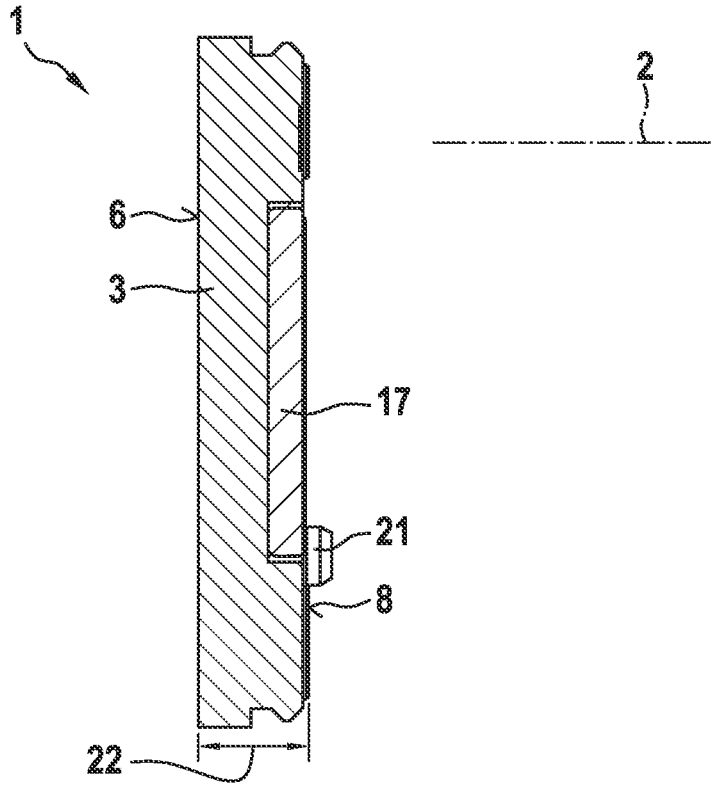
Figure 12:
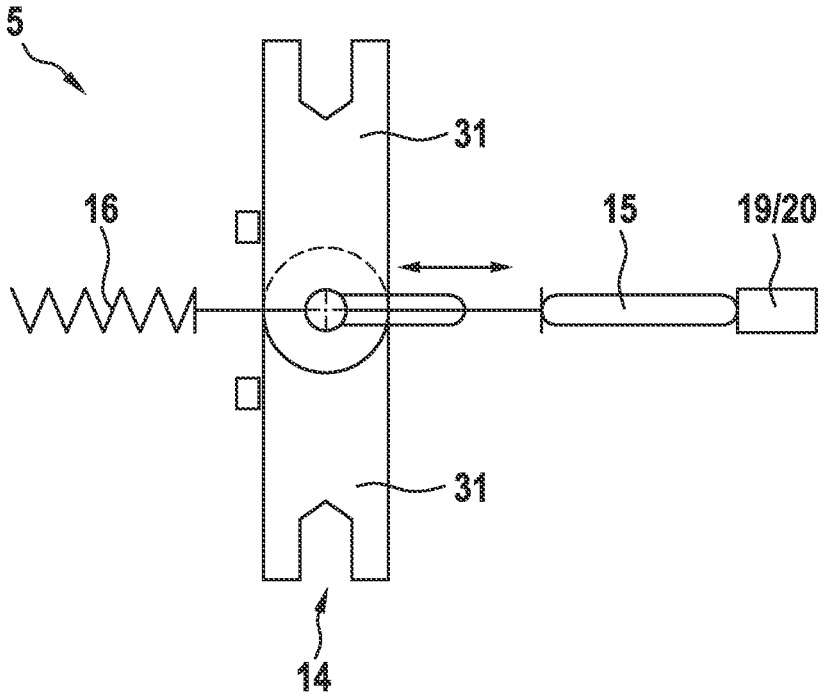
Figure 13:
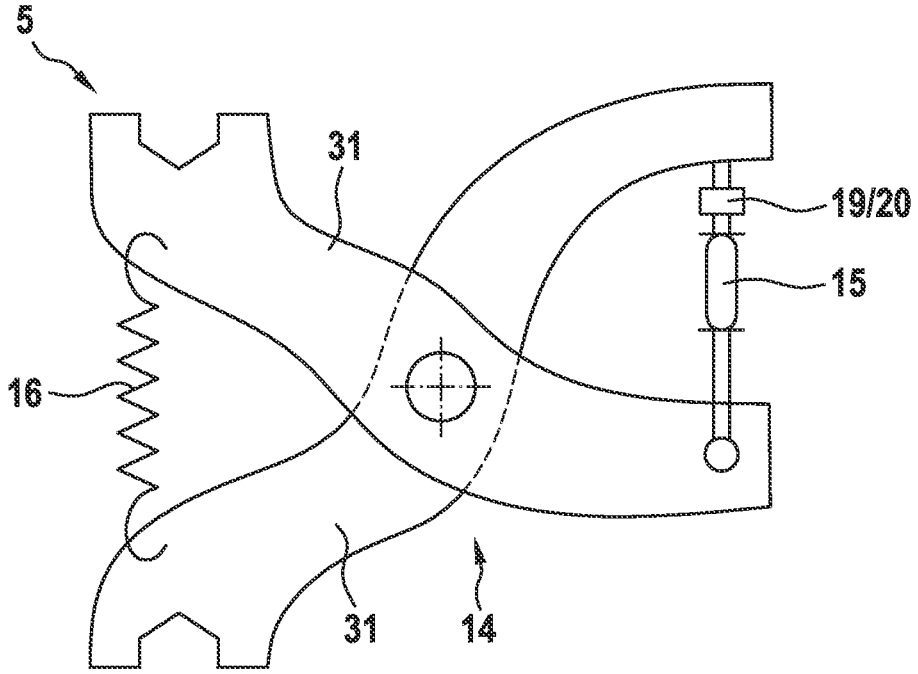

FIG. 8 shows the rear surface 6 of the backplate 1 for the second exemplary embodiment. FIG. 9 shows the section C-C identified in FIG. 8. FIG. 10 is a further sectional view to a section parallel to the drawing plane of FIG. 8. FIG. 11 shows the section D-D identified in FIG. 8. FIGS. 12 and 13 show variants of the second exemplary embodiment.

In the second exemplary embodiment, the bar elements 14 are not moved from top to bottom, but in horizontal direction. For this purpose, FIG. 8 shows the rear surface 6 of the backplate 1. The retaining elements 14 are located in the retaining position. The second mounting element 4 is not formed as a plate. Rather herein, several second mounting elements 4 are used, in this example six. The individual second mounting elements 4 are formed as bushings with female thread 30. Said bushings are fitted in the plate-shaped first mounting element 3. In the illustration according to FIG. 8, the upper right second mounting element 4 is masked.

The second mounting elements 4, formed as bushings, have a groove, preferably with non-round cross-section. Said area serves as the form closure element 10. Corresponding fork-shaped areas of the bar elements 14 engage in said form closure elements 10. Thereby, the second mounting elements 4 are secured against rotation and against falling out.

The door actuator 102 is directly connected, in particular screwed to the bushing-shaped second mounting elements 4, or via a further plate-shaped element. When the second mounting elements 4 detach from the first mounting element 3, the door actuator 102 also falls off.

As for example FIG. 10 clarifies, in the second exemplary embodiment as well, the trigger element 15 props up between bar element 14 and first mounting element 3. For this purpose, again a set screw 19 is provided, which allows for tensioning the trigger element 15 against a compensating spring 20.

Again the drive element 16 is made from thermally intumescent material and, at corresponding thermal load and expansion resulting therefrom, pushes the bar element 14 to the release position thereof.

FIG. 11 shows the arrangement of the detaching element 17 in a corresponding recess in the first mounting element 3. This detaching element 17 directly pushes the door actuator 102 away from the first mounting element 3.

The sectional views in both exemplary embodiments show the definition of the thickness 22 of the backplate 1 parallel to the mounting axis 2. Potential positioning extensions 21, on which the door actuator 102 is fitted, are not considered for the thickness 22.

FIG. 12 shows a variant for embodying the connecting assembly 5 in the second exemplary embodiment. Instead of a rigid bar element 14, herein is used a bar element 14 with two levers 31, which are rotatably supported to each other. Purely, diagrammatically, FIG. 12 shows that upon the trigger element 15 triggering, the point of rotation between said two levers 31 can be displaced via a corresponding drive element 16, whereby the bar element 14 moves to the release position thereof—the fork-shaped sections of the two levers 31 detach from the second mounting element 4.

FIG. 13 shows a further purely diagrammatically illustrated variant to the second exemplary embodiment. Herein, the bar element 14 is again formed by two levers 31 rotatable with regard to each other. The axis of rotation of both levers 31 is stationary. On one side of the axis of rotation, the two levers 31 are connected via the trigger element 15. When the trigger element 15 does not keep both ends of the two levers 13 spaced apart any more, on the opposite side of the axis of rotation, the drive element 16, herein formed as a spring, can pull the two ends with the fork-shaped configurations to each other, so that the bar element 14 moves to the release position thereof.

The invention claimed is:

1. A backplate for a door actuator, comprising a first mounting element and a second mounting element, wherein one of the two mounting elements is formed for fastening to a mounting surface, and the other mounting element for accommodating the door actuator, at least one connecting assembly with a bar element disposed mobile at the first mounting element and a thermally activatable trigger element, wherein the bar element is movable from a retaining position to a release position, wherein, in the retaining position, the bar element retains the second mounting element, and in the release position, releases the second mounting element, and wherein, upon thermal activation, the trigger element releases a movement of the bar element to the release position and/or, upon thermal activation, the trigger element moves the bar element to the release position.

2. The backplate according to claim 1, wherein the trigger element is disposed, between the bar element and the first mounting element to block a movement of the bar element to the release position.

3. The backplate according to claim 1, wherein, under thermal load, the trigger element is destructible, deformable, and/or meltable.

4. The backplate according to claim 1, wherein the bar element is accommodated in a recess of the first mounting element.

5. The backplate according to claim 1, wherein, in the retaining position thereof, the bar element and the second mounting element positively engage in each other.

6. The backplate according to claim 1, wherein the connecting assembly comprises a drive element, with thermally intumescent material and/or a spring for moving the bar element to the release position.

7. The backplate according to claim 1, wherein the drive element is disposed in a recess of the first mounting element and/or in a recess of the second mounting element.

8. The backplate according to claim 1, wherein a detaching element is provided, wherein, the detaching element comprises a thermally intumescent material and/or a spring, wherein the detaching element is disposed for pushing the first and the second mounting elements away from each other.

9. The backplate according to claim 8, wherein the detaching element is disposed in a recess of the first mounting element and/or in a recess of the second mounting element.

10. The backplate according to claim 1, wherein the first mounting element is formed as a plate.

11. The backplate according to claim 1, wherein the second mounting element is formed as a plate.

12. The backplate according to claim 1, wherein a plurality of second mounting elements are provided, which are formed for accommodating the door actuator and/or for fastening to the mounting surface.

13. The backplate according to claim 12, wherein the plurality of second mounting elements, formed as bushings with female thread, are fitted in the first mounting element.

14. The backplate according to claim 1, wherein the backplate has a thickness of maximum 60 mm.

15. An assembly comprising a backplate according to claim 1 and a door actuator, which is fastened to the backplate.

* * * * *